US007183977B2

(12) United States Patent
Suh

(10) Patent No.: US 7,183,977 B2
(45) Date of Patent: Feb. 27, 2007

(54) ANTENNAS FOR MULTICARRIER COMMUNICATIONS AND MULTICARRIER TRANSCEIVER

(75) Inventor: Seong-Youp Suh, San Jose, CA (US)

(73) Assignee: Intel Corporation, Santa Clara, CA (US)

( * ) Notice: Subject to any disclaimer, the term of this patent is extended or adjusted under 35 U.S.C. 154(b) by 216 days.

(21) Appl. No.: 10/954,018

(22) Filed: Sep. 28, 2004

(65) Prior Publication Data

US 2006/0071858 A1 Apr. 6, 2006

(51) Int. Cl.
*H01Q 1/38* (2006.01)

(52) U.S. Cl. ..... 343/700 MS; 343/767; 343/795

(58) Field of Classification Search ..... 343/700 MS, 343/702, 767, 795, 829, 846, 845
See application file for complete search history.

(56) References Cited

U.S. PATENT DOCUMENTS

| | | | | |
|---|---|---|---|---|
| 4,605,933 | A * | 8/1986 | Butscher | 343/700 MS |
| 4,843,403 | A * | 6/1989 | Lalezari et al. | 343/767 |
| 5,278,575 | A * | 1/1994 | Thomas | 343/795 |
| 5,872,546 | A * | 2/1999 | Ihara et al. | 343/795 |
| 5,949,383 | A * | 9/1999 | Hayes et al. | 343/795 |
| 6,154,659 | A * | 11/2000 | Jalali et al. | 455/522 |
| 6,337,666 | B1 * | 1/2002 | Bishop | 343/795 |
| 6,369,771 | B1 * | 4/2002 | Chiang et al. | 343/795 |
| 6,654,408 | B1 * | 11/2003 | Kadous et al. | 375/148 |
| 7,023,396 | B2 * | 4/2006 | Thudor et al. | 343/829 |

* cited by examiner

*Primary Examiner*—Michael C. Wimer
(74) *Attorney, Agent, or Firm*—Schwegman, Lundberg, Woessner & Kluth, P.A.

(57) ABSTRACT

Small and compact antennas are suitable for use in portable wireless communication devices, including wireless local area network (WLANs) devices.

18 Claims, 9 Drawing Sheets

ANTENNAS FOR MULTICARRIER COMMUNICATIONS AND MULTICARRIER TRANSCEIVER

TECHNICAL FIELD

Embodiments of the present invention pertain to wireless communications. Some embodiments pertain to antennas. Some embodiments pertain to multicarrier communications.

BACKGROUND

Wireless communication devices include, for example, laptop and portable computers that operate as part of wireless local area networks (WLANs), as well as personal communication devices, such as personal digital assistants (PDAs) and mobile telephones. Wireless communication devices require an antenna to transmit and receive communication signals. As these wireless communication devices become smaller and more compact, it becomes increasingly difficult for antennas to meet size requirements while providing acceptable performance. For example, many wireless communication devices operate over wider frequency bands including ultra wideband (UWB). Antennas that operate over these wider frequency bands are difficult to design, especially when constrained by size limitations of today's wireless communication devices.

Thus, there are general needs for antennas suitable for smaller and more compact wireless communication devices. There are also needs for antennas that operate over wider frequency bands that may be suitable for smaller and more compact wireless communication devices.

DETAILED DESCRIPTION

The following description and the drawings illustrate specific embodiments of the invention sufficiently to enable those skilled in the art to practice them. Other embodiments may incorporate structural, logical, electrical, process, and other changes. Examples merely typify possible variations. Individual components and functions are optional unless explicitly required, and the sequence of operations may vary. Portions and features of some embodiments may be included in or substituted for those of others. Embodiments of the invention set forth in the claims encompass all available equivalents of those claims. Embodiments of the invention may be referred to, individually or collectively, herein by the term "invention" merely for convenience and without intending to voluntarily limit the scope of this application to any single invention or inventive concept if more than one is in fact disclosed.

Figure 1A:
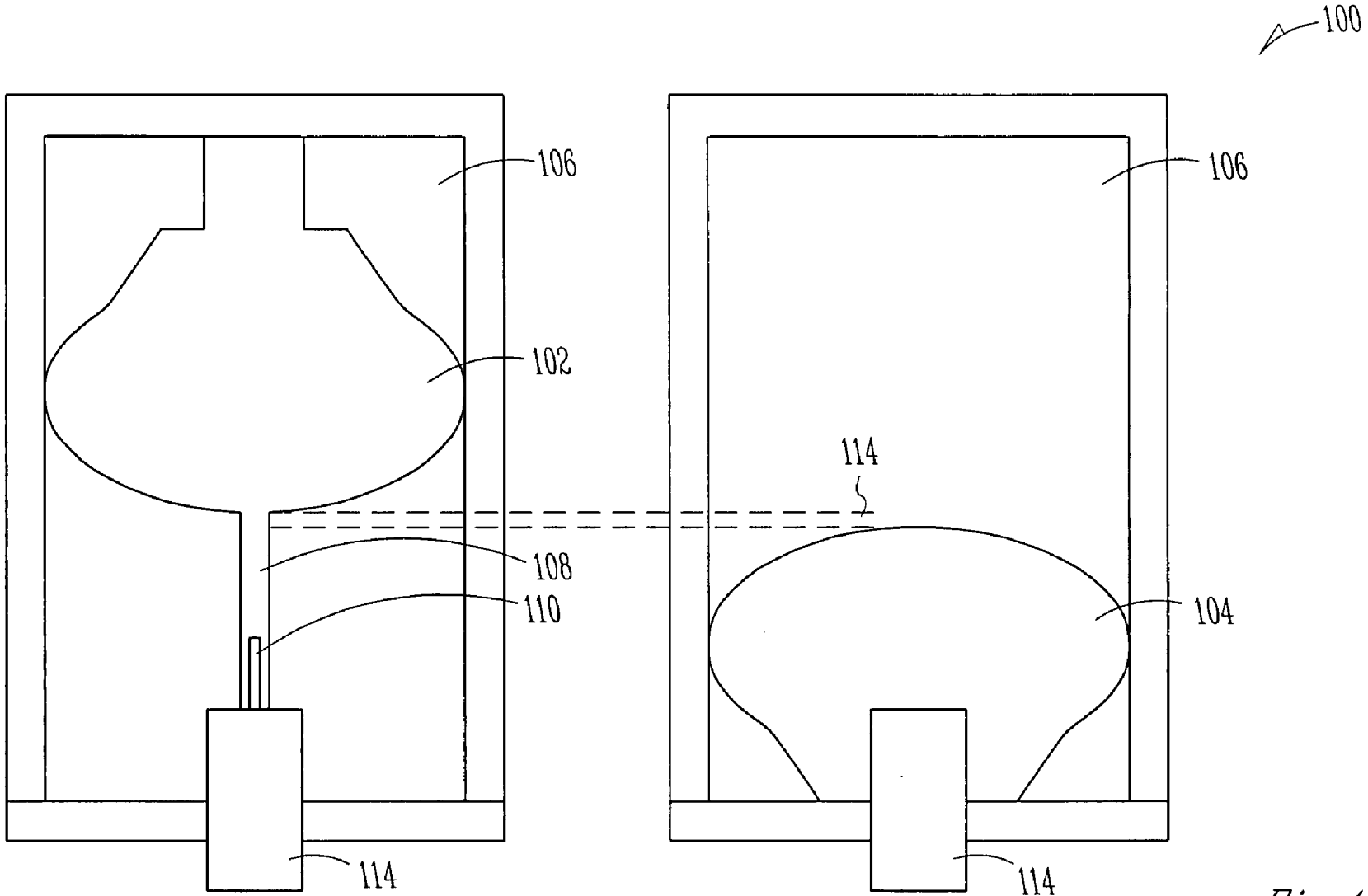
FIGS. 1A through 1D illustrate microstrip-fed balanced antennas in accordance with some embodiments of the present invention.
Figure 1B:
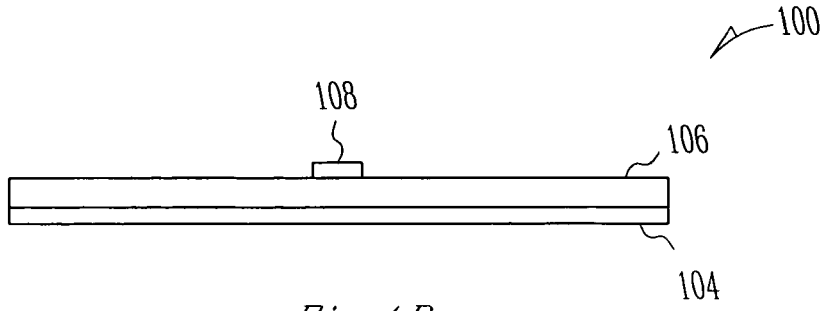
Figure 1C:
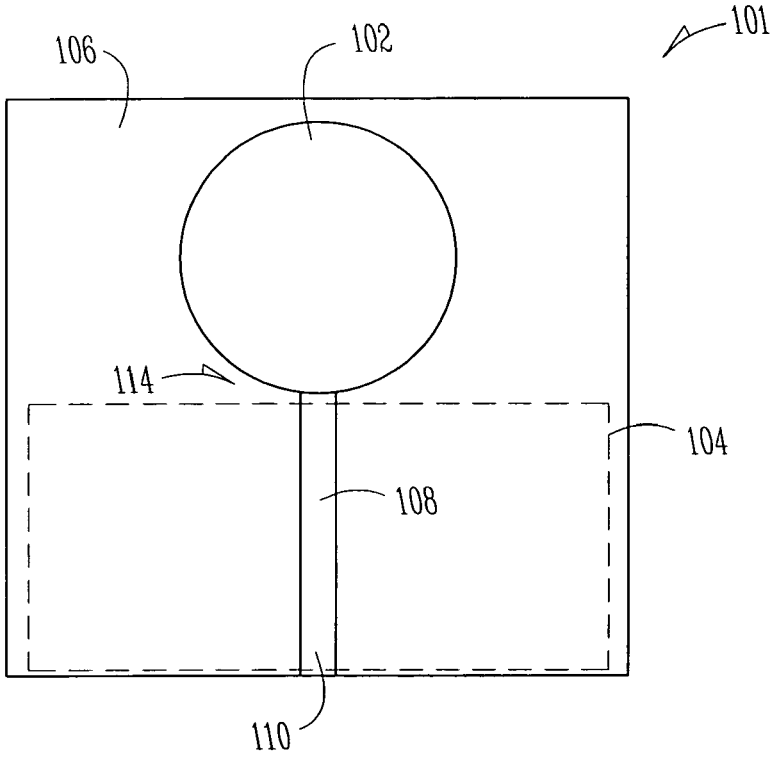
Figure 1D:
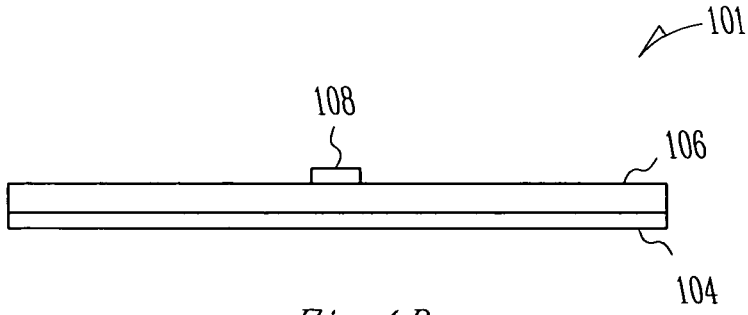

FIGS. 1A through 1D illustrate microstrip-fed balanced antennas in accordance with some embodiments of the present invention. FIG. 1A illustrates front and back views of antenna 100, and FIG. 1B illustrates a side view of antenna 100. FIG. 1C illustrates a front view of antenna 101, and FIG. 1D illustrates a side view of antenna 101. Antennas 100 and 101 comprise first radiating element 102 disposed on a first side of insulating substrate 106, second radiating element 104 disposed on a second side of insulating substrate 106, and microstrip feed line 108 disposed on the first side of the substrate 106. Microstrip feed line 108 extends across the first side from feed point 110 opposite second radiating element 104 to couple with first radiating element 102.

Antennas 100 and 101 may be broadband balanced antennas. The form factor of antennas 100 and 101 may be very thin and suitable for space-limited platforms, such as portable and laptop computers and other wireless communication devices. In some embodiments, the performance of antennas 100 and 101 may be consistent over a broad frequency range of more than a three-to-one bandwidth and may be suitable for ultra-wide band (UWB) wireless technology, although the scope of the invention is not limited in this respect.

In some embodiments, first and second radiating elements 102 & 104 may have spacing 114 therebetween selected to impedance-match the antenna. In some embodiments, spacing 114 may be selected or tuned to provide impedance-matching to allow antennas 100 and 101 to operate over an ultra-wide band of operation (e.g., as wide as up to 3 to 12 GHz). In some embodiments, spacing 114 may include at least the thickness of substrate 106 which separates the radiating elements.

In some embodiments, first radiating element 102 may have a distance across of slightly less than approximately ¼ wavelength at approximately a lower frequency of operation for the antenna. In these embodiments, second radiating element 104 may have dimensions of slightly less than approximately ¼ wavelength at approximately the lower frequency of operation.

In some embodiments, microstrip feed line 108 and second radiating element 104 are fed substantially out-of-phase. For example, feed line 108 and second radiating element 104 may be fed by signal components of a radio-frequency (RF) signal that are 180 degrees out of phase (i.e., an in-phase component and an out-of-phase component), although the scope of the invention is not limited in this respect. In this way, a separate balun is not required.

In some embodiments, one end of feed line 108 couples with feed point 110 to receive a first signal component of an RF signal from a center conductor of coaxial connector 114. Second radiating element 104 may further couple with feed point 110 to receive a second signal component of the RF signal from an outer conductor of coaxial connector 114.

In some embodiments, the signal components comprise a multicarrier communication signal, although the scope of the invention is not limited in this respect. The multicarrier communication signal may comprise a plurality of substantially orthogonal subcarriers and each subcarrier may have a null at about a center frequency of other subcarriers of the multicarrier communication signal to provide for substantial orthogonality between the subcarriers.

FIG. 1A illustrates the front and back sides of antenna 100. In the example embodiments illustrated in FIGS. 1A and 1B, first radiating element 102 and second radiating element 104 may have rounded, fanned-out shapes positioned in opposition, as shown.

As illustrated in FIGS. 1C and 1D, first radiating element 102 of antenna 101 may be approximately circular, and second radiating element 104 may be approximately rectangular. In some embodiments, both the first and second radiating elements may have the same shape. For example, both elements may be approximately circular, both elements may be rectangular, or both elements may have another shape. In some other embodiments, first radiating element 102 may be somewhat elliptical in shape.

Although FIGS. 1A through 1D illustrate antennas 100 and 101 with first and second radiating elements on opposite sides, this is not a requirement. In some embodiments, the first and second radiating elements may be on the same side of insulating substrate 106. In these embodiments, microstrip feed line 108 may be on the opposite side of substrate 106 and may couple through substrate 106 to feed first radiating element 102. Spacing 114 between the radiating elements may be selected to tune the impedance and set the bandwidth of antennas 100 and 101.

In some embodiments, microstrip feed line 108 may be tapered for improved impedance matching. In these embodiments, microstrip feed line 108 may be narrower at the point it couples with first radiating element 102, although the scope of the invention is not limited in this respect.

Figure 2A:
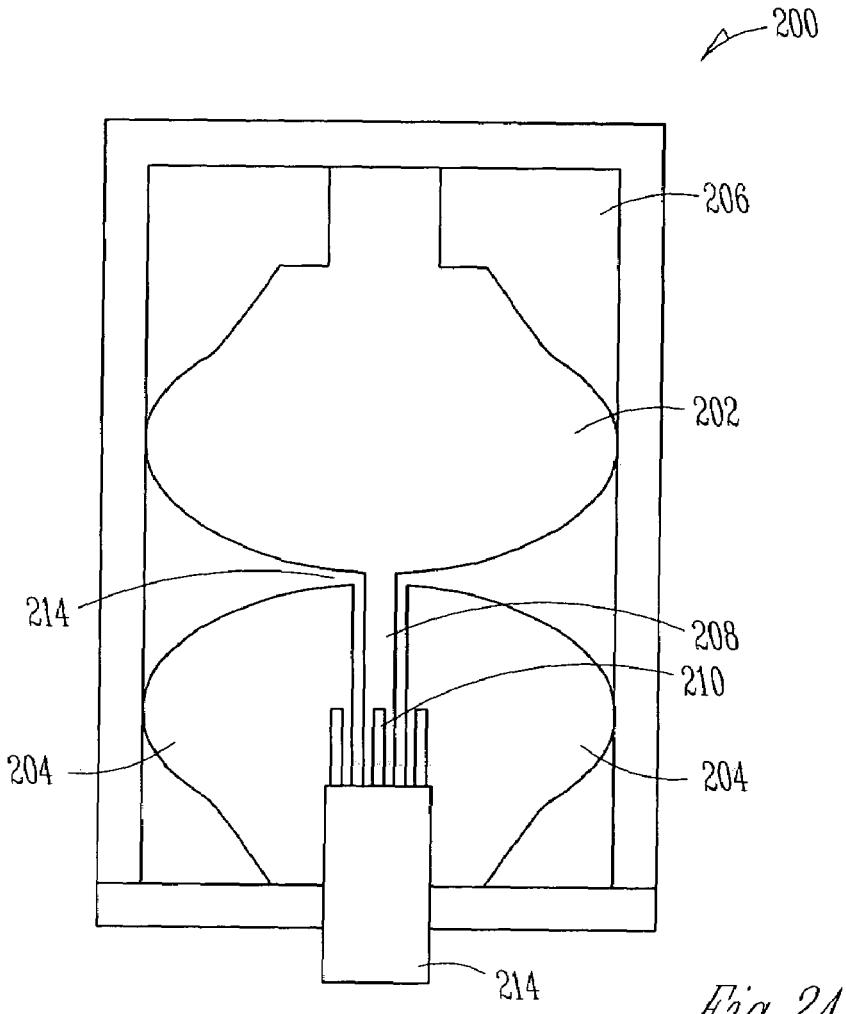
FIGS. 2A through 2D illustrate coplanar waveguide-fed balanced antennas without ground planes in accordance with some embodiments of the present invention.
Figure 2B:
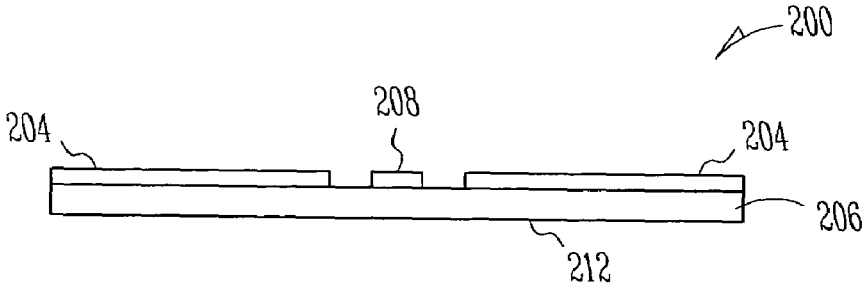
Figure 2C:
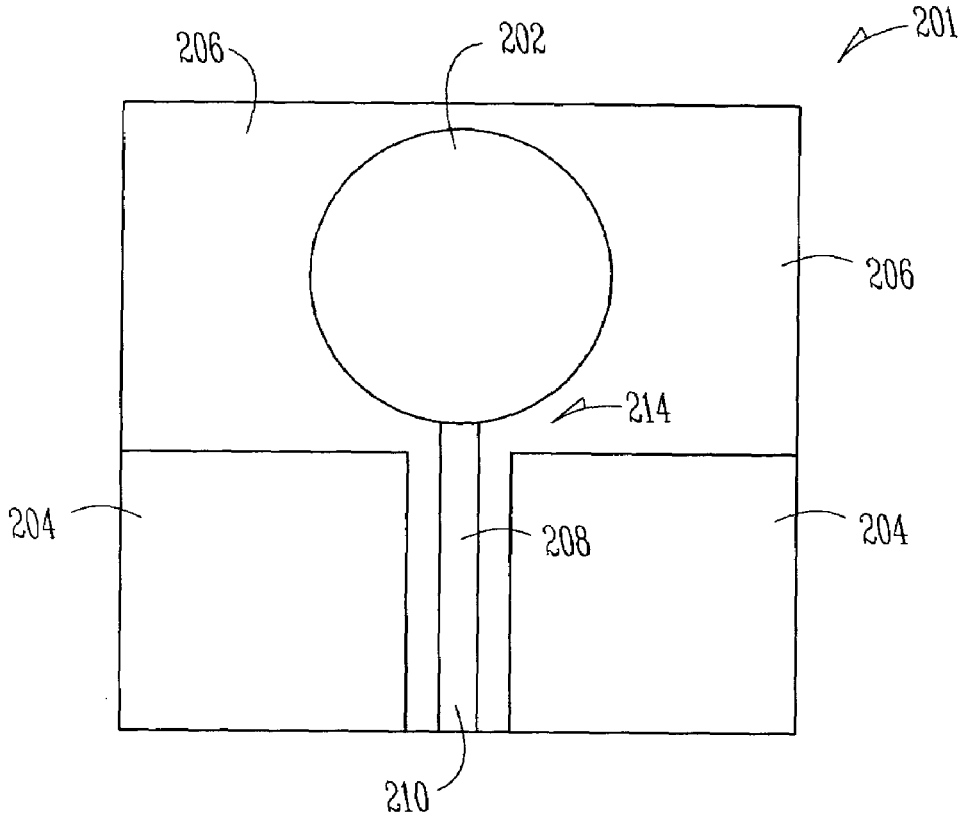
Figure 2D:
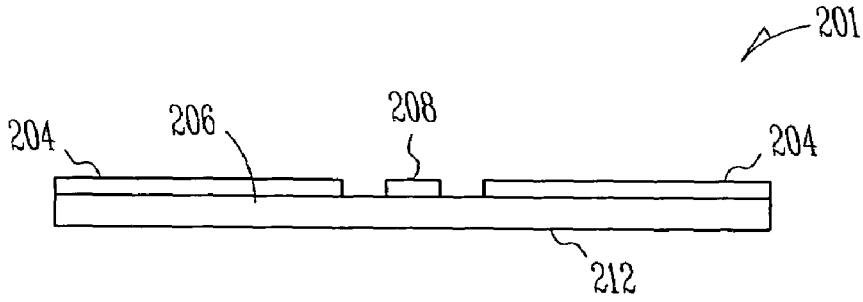

FIGS. 2A through 2D illustrate coplanar waveguide-fed balanced antennas without ground planes in accordance with some embodiments of the present invention. FIG. 2A illustrates a front view of antenna 200, and FIG. 2B illustrates a side view of antenna 200. FIG. 2C illustrates a front view of antenna 201, and FIG. 2D illustrates a side view of antenna 201. Antennas 200 and 201 may comprise first radiating element 202 disposed on a first side of insulating substrate 206, and second radiating elements 204 disposed on the first side of insulating substrate 206. Antennas 200 and 201 may also include coplanar waveguide feed line 208 disposed on the first side of the insulating substrate. Coplanar waveguide feed line 208 may extend across the first side of insulating substrate 206 from feed point 210 between second radiating elements 204 to couple with first radiating element 202. Coplanar waveguide feed line 208 and second radiating elements 204 define a coplanar waveguide structure.

The form factor of antennas 200 & 201 may be very thin and suitable in space limited platforms, such as portable and laptop computers and other wireless communication devices. In some embodiments, the performance of antennas 200 & 201 may be consistent over a broad frequency range of more than a three-to-one bandwidth and may be suitable for UWB wireless technology, although the scope of the invention is not limited in this respect.

In some embodiments, the first and second radiating elements have spacing 214 therebetween having dimensions selected to impedance-match the antenna. In some embodiments, spacing 214 may be selected or tuned to provide impedance-matching to allow antennas 200 and 201 to operate over an ultra-wide band of operation (e.g., as wide as up to 3 to 12 GHz).

In the example embodiments illustrated in FIG. 2A, first radiating element 202 may have a rounded, fanned-out shape, and second radiating elements 204 together may have a rounded, fanned-out shape, as illustrated. The fanned-out shapes may be positioned oppositely, as illustrated in FIG. 2A. In the embodiments illustrated in FIGS. 2C and 2D, first radiating element 202 of antenna 201 may be approximately circular and second radiating elements 204 may be approximately square, although the scope of the invention is not limited in this respect.

In some embodiments, first radiating element 202 may have a distance across of slightly less than approximately ¼ wavelength at a lower frequency of operation for the antenna, and second radiating elements 204 may have dimensions of slightly less than approximately ¼ wavelength by slightly less than approximately ¼ wavelength at the lower frequency of operation, although the scope of the invention is not limited in this respect.

In some embodiments, second side opposite 212 of insulating substrate 206 may be substantially devoid of conductive material at least in areas opposite first radiating element 202, second radiating elements 204 and coplanar waveguide feed line 208.

In some embodiments, feed line 208 and second radiating elements 204 may be fed substantially out-of-phase. For example, feed line 208 and second radiating elements 204 may be fed by signal components of an RF signal that are 180 degrees out of phase (i.e., an in-phase component and an out-of-phase component), although the scope of the invention is not limited in this respect. In this way, a separate balun is not required.

In some embodiments, one end of feed line 208 couples with feed point 210 to receive a first signal component of an RF signal from a center conductor of coaxial connector 214. Second radiating elements 204 may further couple with feed point 210 to receive a second signal component of the RF signal from an outer conductor of coaxial connector 214. In some embodiments, the signal components comprise a multicarrier communication signal, although the scope of the invention is not limited in this respect.

Figure 3A:
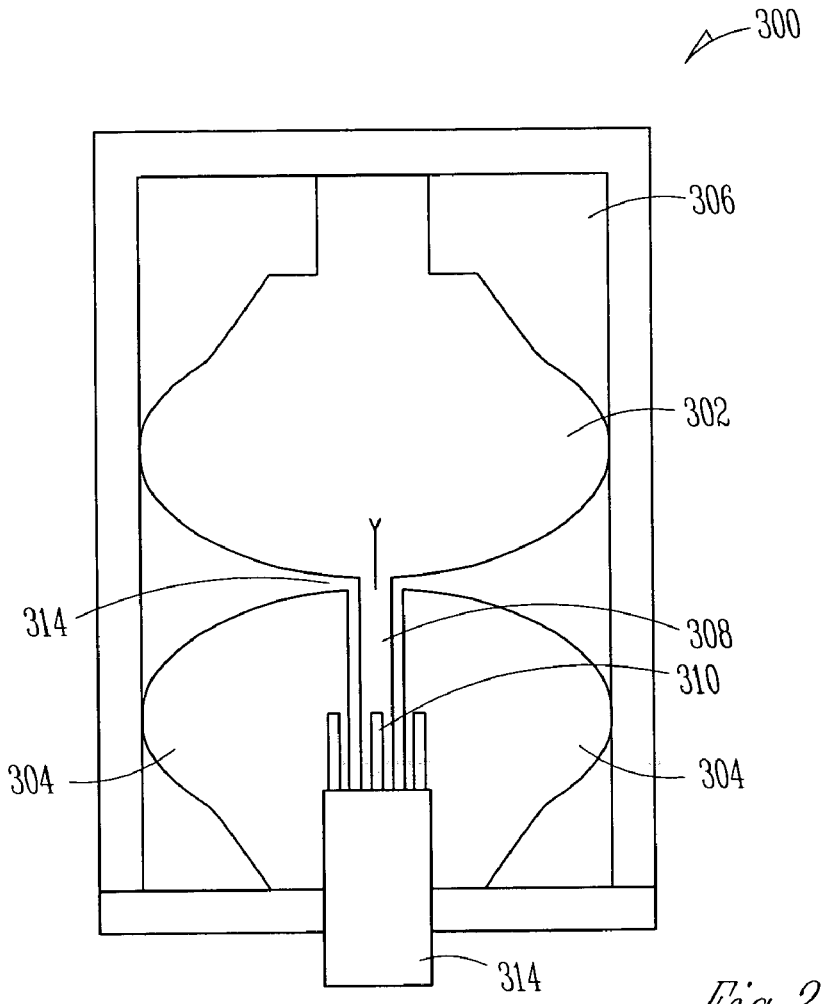
FIGS. 3A through 3D illustrate coplanar waveguide-fed balanced antennas with tapered-feeds without ground planes in accordance with some embodiments of the present invention.
Figure 3B:
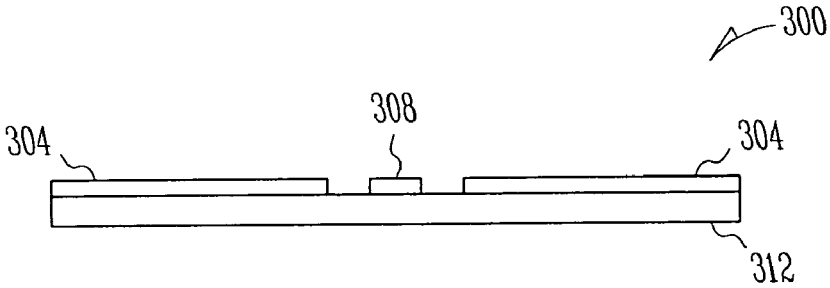
Figure 3C:
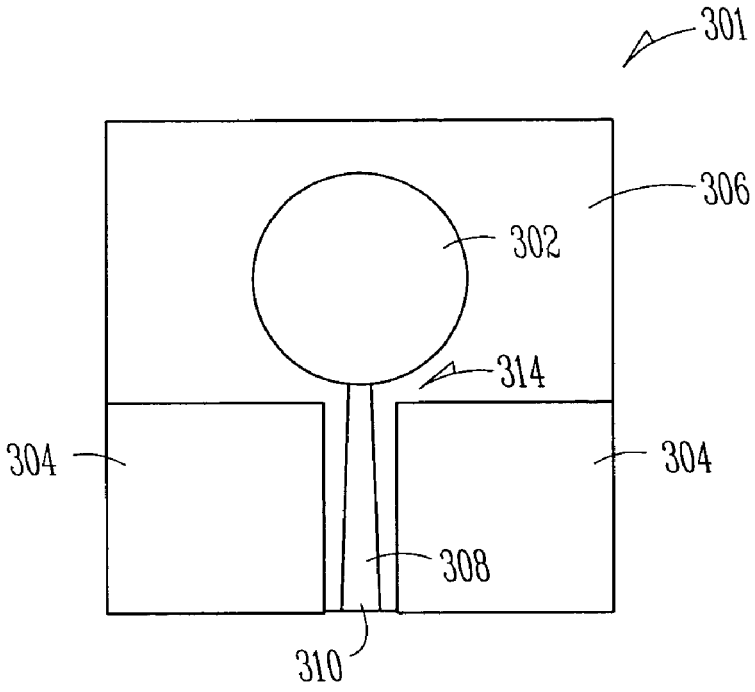
Figure 3D:
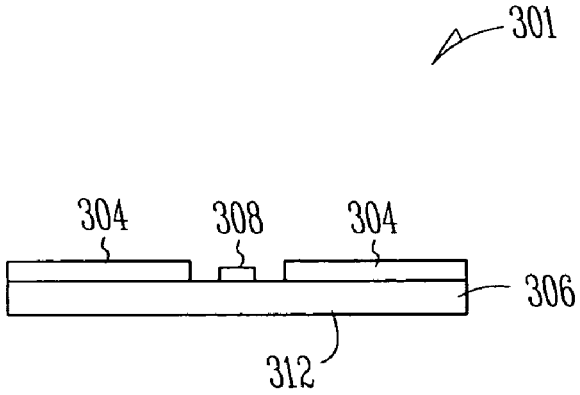

FIGS. 3A through 3D illustrate coplanar waveguide-fed balanced antennas with tapered-feeds without ground planes in accordance with some embodiments of the present invention. FIG. 3A illustrates a front view of antenna 300, and FIG. 3B illustrates a side view of antenna 300. FIG. 3C illustrates a front view of antenna 301, and FIG. 3D illustrates a side view of antenna 301. Antennas 300 and 301 may comprise first radiating element 302 disposed on a first side of insulating substrate 306, and second radiating elements 304 disposed on the first side of insulating substrate 306. Antennas 300 and 301 also include coplanar waveguide feed line 308 disposed on the first side of insulating substrate 306. Coplanar waveguide feed line 308 may extend across the first side of insulating substrate 306 from feed point 310 between second radiating elements 304 to couple with first radiating element 302. Coplanar waveguide feed line 308 and second radiating elements 304 define a coplanar waveguide structure.

As illustrated, coplanar waveguide feed lines 308 of antennas 300 and 301 are tapered from feed point 310 to first radiating element 302. In some embodiments, tapered feed lines 308 may provide better impedance-matching over a broader bandwidth than untapered feed lines. In some embodiments, tapered feed lines 308 are narrower at first radiating element 302 and wider at feed point 310.

The form factor of antennas 300 & 301 may be very thin and suitable in space limited platforms, such as portable and laptop computers and other wireless communication devices. In some embodiments, the performance of antennas 300 & 301 may be consistent over a broad frequency range of more than a three-to-one bandwidth and may be suitable for UWB wireless technology, although the scope of the invention is not limited in this respect.

In some embodiments, the first and second radiating elements have spacing 314 therebetween having dimensions selected to impedance-match the antenna. In some embodiments, spacing 314 may be selected or tuned to provide impedance-matching to allow antennas 300 and 301 to operate over an ultra-wide band of operation (e.g., as wide as up to 3 to 12 GHz).

In the example embodiments illustrated in FIGS. 3A and 3B, first radiating element 302 and second radiating elements 304 may have a rounded, fanned-out shape, as shown. In the embodiments illustrated in FIGS. 3C and 3D, first radiating element 302 of antenna 301 may be approximately circular, second radiating elements 304 may be approximately square, although the scope of the invention is not limited in this respect.

In some embodiments, first radiating element 302 may have a distance across of slightly less than approximately ¼ wavelength at a lower frequency of operation for the antenna, and second radiating elements 304 may have dimensions of slightly less than approximately ¼ wavelength by slightly less than approximately ¼ wavelength at the lower frequency of operation, although the scope of the invention is not limited in this respect. In some embodiments, second side opposite 312 of insulating substrate 306 may be substantially devoid of conductive material at least in areas opposite first radiating element 302, second radiating elements 304 and coplanar waveguide feed line 308.

In some embodiments, feed line 308 and second radiating elements 304 may be fed substantially out-of-phase. For example, feed line 308 and second radiating elements 304 may be fed by signal components of an RF signal that are 180 degrees out of phase (i.e., an in-phase component and an out-of-phase component), although the scope of the invention is not limited in this respect. In this way, a separate balun is not required.

In some embodiments, one end of feed line 308 couples with feed point 310 to receive a first signal component of an RF signal from a center conductor of coaxial connector 314. Second radiating elements 304 may further couple with feed point 310 to receive a second signal component of the RF signal from an outer conductor of coaxial connector 314. In some embodiments, the signal components comprise a multicarrier communication signal, although the scope of the invention is not limited in this respect.

Figure 4A:
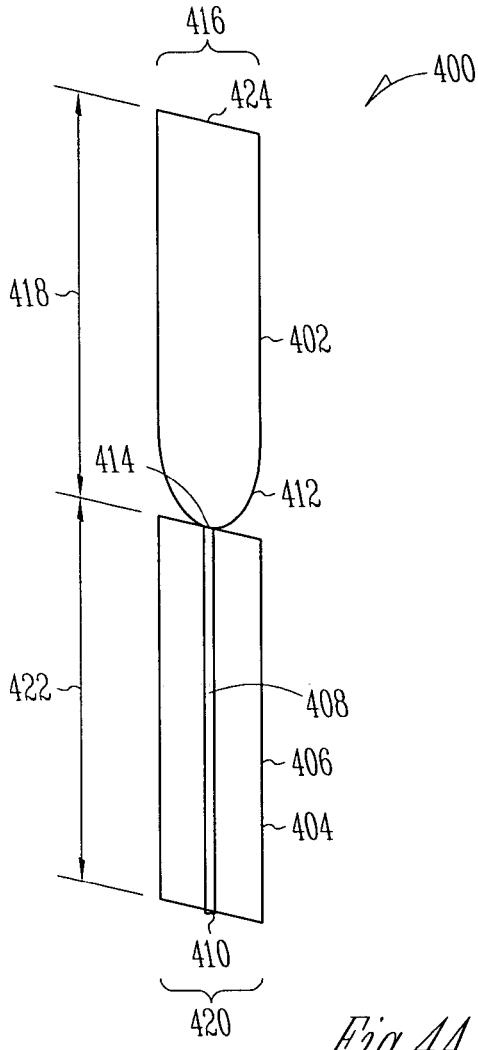
FIGS. 4A and 4B illustrate a narrow-band printed antenna in accordance with some embodiments of the present invention.
Figure 4B:
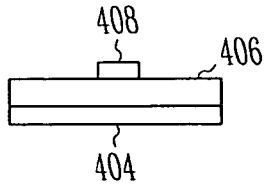

FIGS. 4A and 4B illustrate a narrow-band printed antenna in accordance with some embodiments of the present invention. FIG. 4A illustrates a perspective view of antenna 400 and FIG. 4B illustrates a side view of antenna 400. Antenna 400 may be a compact narrowband antenna and may comprise first radiating element 402 having curved portion 412 and comprising conductive material disposed on a first side of insulating substrate 406. Antenna 400 may also comprise second radiating element 404 disposed on a second side of insulating substrate 406, and feed line 408 disposed on the first side of the insulating substrate 406 opposite second radiating element 404. Feed line 408 couples to curved portion 412 of first radiating element 402.

First and second radiating elements 402 and 404 may have separation 414 therebetween. In some embodiments, separation 414 may have dimensions selected to, at least in part, determine a bandwidth of the antenna 400. In some embodiments, separation 414 may include at least the thickness of substrate 406. In some embodiments, separation 414 may be an amount of offset or overlap between first radiating element 402 on the first side of insulating substrate 406 and second radiating element 404 on the second side of insulating substrate 406. In some embodiments, separation 414 may be a slot, gap, spacing or overlap between first radiating element 402 and second radiating element 404. In other words, separation 414 may be the distance from the point at which feed line 408 couples to first radiating element 402 on the first side of substrate 406 to the nearest edge of second radiating element 404 on the second side of substrate 406. In some embodiments, separation 414 may be less than 0.1 wavelength at approximately a lower frequency of operation.

In some embodiments, an amount of curvature of curved portion 412, width dimension 416 of first radiating element 402 and height dimension 418 of first radiating element 402 may be selected to determine performance characteristics including impedance-matching of antenna 400. In some embodiments, first radiating element 402 may have substantially flat end portion 424 opposite curved portion 412, and second radiating element 404 may be substantially rectangular, although in other embodiments, second radiating element 404 may also have a curved portion.

In some embodiments, feed line 408 is a microstrip feed line. In some embodiments, feed line 408 may be slightly tapered (i.e., slightly narrower at radiating element 402) to enhance performance, although the scope of the invention is not limited in this respect. Other types of feed lines may also be suitable for use as feed line 408.

In some embodiments, antenna 400 may have a bandwidth at least as great as a 20 MHz multicarrier communication channel, although the scope of the invention is not limited in this respect. In some embodiments, width dimension 416 may be less than 0.1 wavelength at approximately a lower frequency of operation and height dimension 418 may be approximately ¼ wavelength at approximately the lower frequency of operation. Second radiating element 404 may have width dimension 420 of less than 0.1 wavelength at approximately the lower frequency of operation and height dimension 422 of approximately ¼ wavelength at approximately the lower frequency of operation.

In some embodiments, width dimension 416 of first radiating element 402 and width dimension 420 of second radiating element 404 may be approximately 0.4 inches for a lower frequency of operation between 2.3 and 2.5 GHz. In these embodiments, height dimension 418 of first radiating element 402 and height dimension 422 of second radiating element 404 may be approximately 1.25 inches for the lower frequency of operation between 2.3 and 2.5 GHz. In these embodiments, insulating substrate 406 may be approximately 0.031 inch thick and have a dielectric constant of 2.33, although the scope of the invention is not limited in this respect. In these embodiments, the total height of antenna 400 may be about 2.5 inches. In some other embodiments, the dimension of the elements of antenna 400 may be selected to operate with a lower frequency of operation between 4.9 to 5.9 GHz. In some embodiments, antenna 400 may provide a dipole-like substantially omnidirectional pattern with a single feed connector (not illustrated).

In some embodiments, feed line 408 and second radiating element 404 may be fed substantially out-of-phase. In this way, a separate balun may not be required. In some embodiments, one end of feed line 408 couples with feed point 410 to receive a first signal component of an RF signal from a center conductor of a coaxial connector, and second radiating element 404 couples with feed point 110 to receive a second signal component of the RF signal from an outer conductor of the coaxial connector. In some embodiments, the signal components may comprise a multicarrier communication signal, although the scope of the invention is not limited in this respect.

Figure 5A:
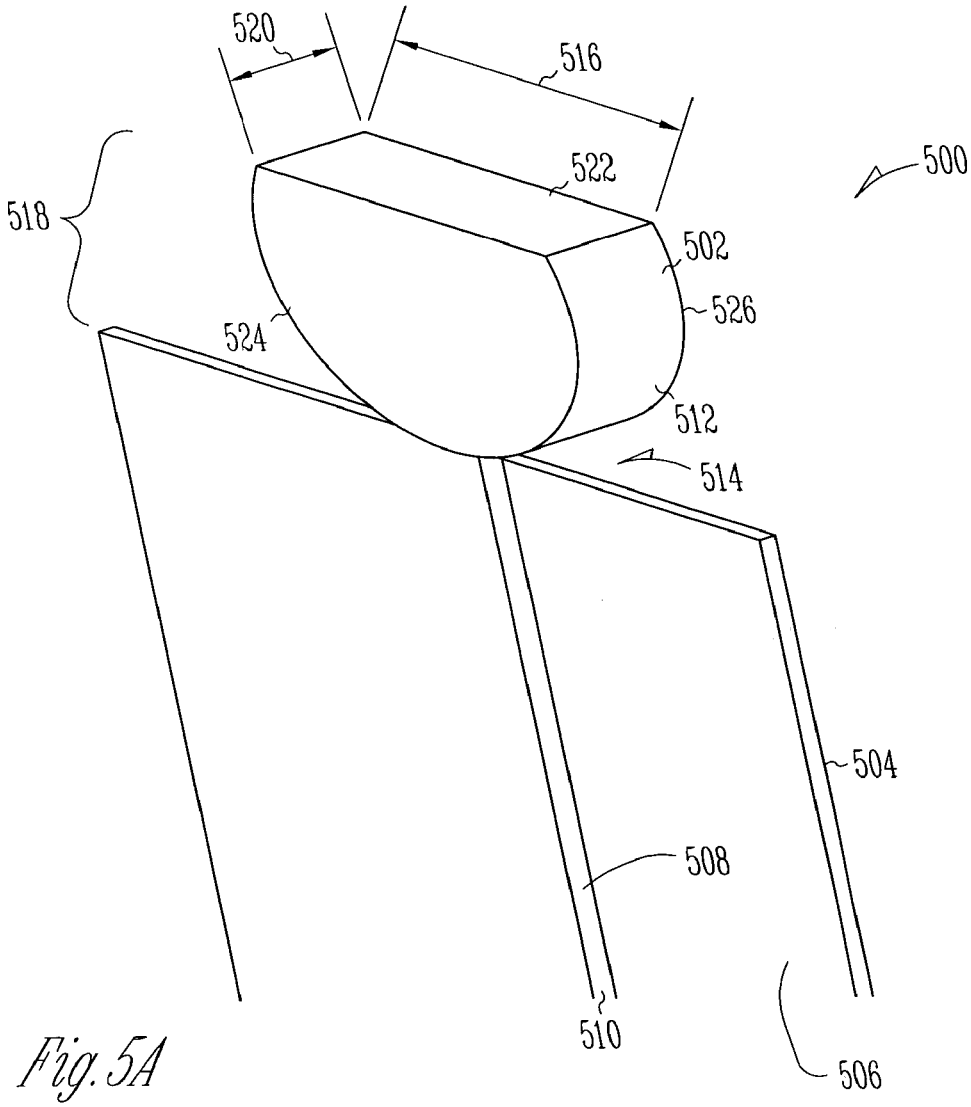
FIG. 5A illustrates a wide-band antenna in accordance with some embodiments of the present invention.

FIG. 5A illustrates a wide-band antenna in accordance with some embodiments of the present invention. Antenna 500 may be a wideband antenna and may comprise a first thick upper radiating element 502 with curved base 512, substantially flat top 522 and substantially flat first and second opposite sides 524 & 526. Antenna 500 may also comprise feed line 508 disposed on a first side of insulating substrate 506 to couple with curved base 512. Antenna 500 may also comprise second radiating element 504 disposed on a second side of insulating substrate 506. First radiating element 502 may have conductive material substantially covering curved base 512, substantially flat top 522 and the substantially flat first and second opposite sides 524 & 526.

In some embodiments, the form factor of antenna 500 and its performance may be suitable for UWB wireless technology, including frequency ranges from about 3–12 GHz. First radiating element 502 may be thicker and relatively smaller that conventional radiating elements for UWB technology and may enhance impedance-matching.

In some embodiments, feed line 508 may be coupled to first radiating element 502 at approximately a center of curved base 512. The curvature of curved base 512, thickness dimension 520, width dimension 516 and height dimension 518 of first radiating element 502 may be selected to provide impedance-matching over a predetermined frequency bandwidth. In some embodiments, spacing 514 between curved base 512 and second radiating element 504 may be selected for further determining a bandwidth and impedance-matching antenna 500, although the scope of the invention is not limited in this respect.

In some embodiments, feed line 508 comprises a microstrip feed line. In some embodiments, feed line 508 and second radiating element 504 may be printed on substrate 506. In some embodiments, feed line 508 and second radiating element 504 may comprise a coplanar waveguide feed line structure, although the scope of the invention is not limited in this respect.

In some embodiments, first and second opposite sides 524 & 526 may reside in parallel planes and have either an approximate semicircular or semi-elliptical shape. The either approximate semicircular or semi-elliptical shape may range from 30% to 70% of either a circular shape or an elliptical shape, although the scope of the invention is not limited in this respect.

In some embodiments, thickness dimension 520 may be at least 0.05 wavelength at approximately a lower frequency of operation, width dimension 516 may be at least 0.3 wavelength at approximately the lower frequency of operation, and height dimension 518 may be at least 0.1 wavelength at approximately the lower frequency of operation.

Figure 5B:
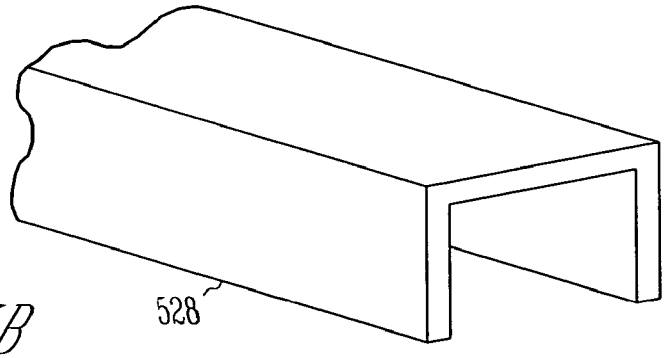
FIG. 5B illustrates a support apparatus for the antenna of FIG. 5A in accordance with some embodiments of the present invention.

In some embodiments, antenna 500 may use support apparatus 528 (FIG. 5B) to support at least first radiating element 502. In some embodiments, support apparatus 528 may be used to hold the first radiating element 502 within a wireless communication device. In some embodiments, first radiating element 502 may be suitable for placement in an edge of a monitor, such as a liquid-crystal display (LCD) monitor, of a computer system, although the scope of the invention is not limited in this respect. In these embodiments, the monitor edge may be suitable for use as support apparatus 528 (FIG. 5B).

In some embodiments, feed line 508 and second radiating element 504 may be fed substantially out-of-phase. In this way, a separate balun may not be required. In some embodiments, one end of the feed line 508 couples with feed point 510 to receive a first signal component of an RF signal from a center conductor of a coaxial connector, and second radiating element 504 further couples with feed point 510 to receive a second signal component of the RF signal from an outer conductor of the coaxial connector. In some embodiments, the signal components may comprise a multicarrier communication signal, although the scope of the invention is not limited in this respect.

Figure 6:
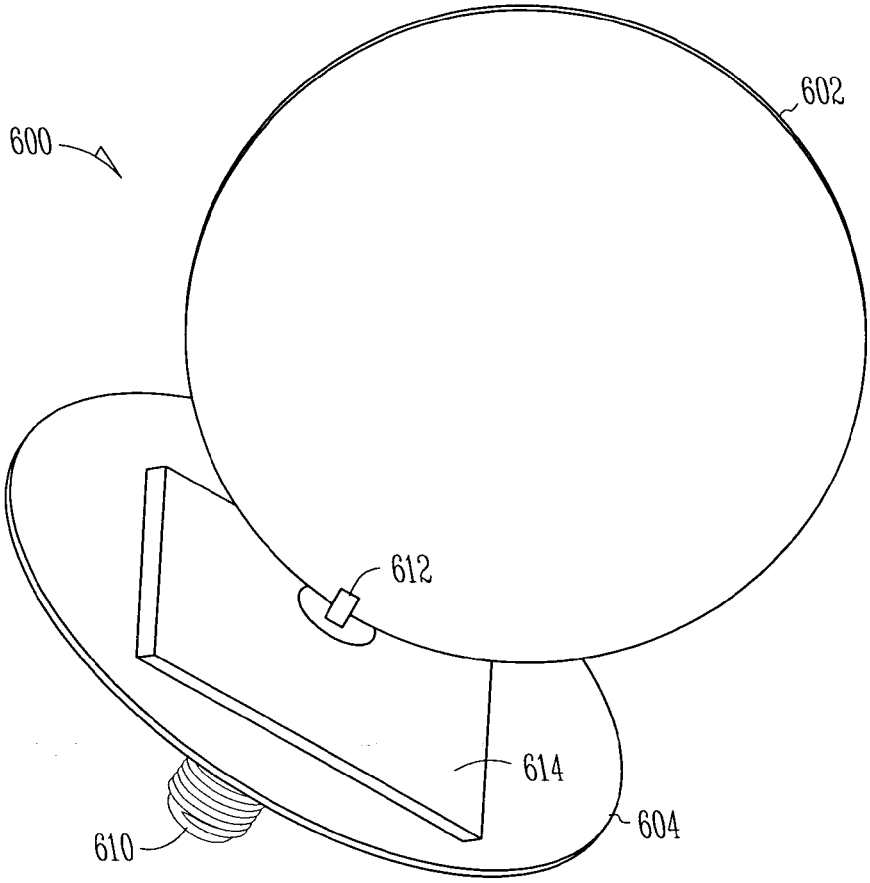
FIG. 6 illustrates a dual disc antenna in accordance with some embodiments of the present invention.

FIG. 6 illustrates a dual disc antenna in accordance with some embodiments of the present invention. Antenna 600 may be a broadband dual disc antenna and may comprise first and second approximately circular radiating elements 602 & 604 positioned perpendicularly and having spacing 614 therebetween. Second radiating element 604 may serve as a ground plane for first radiating element 602, although the scope of the invention is not limited in this respect.

In some embodiments, spacing 614 may have a dimension selected to impedance-match the antenna. In some embodiments, spacing 614 may be selected or tuned to provide impedance-matching to allow antenna 600 to operate over an UWB of operation (e.g., as wide as up to 3–12 GHz or more). In some embodiments, antenna 600 may further comprise insulating material 612 to separate first and second radiating elements 602 & 604 and to define, at least in part, spacing 614.

In some embodiments, the approximately circular radiating elements 602 & 604 may comprise approximately circular substantially flat conductive discs. In some embodiments, radiating elements 602 & 604 may be slightly elliptical, although the scope of the invention is not limited in this respect. Other shapes may also be suitable. In some embodiments, radiating elements 602 & 604 may be conductive on both sides and their edges and may comprise solid conducive elements.

In some embodiments, radiating elements 602 & 604 may have a thickness of less than 0.1 wavelength at approximately a lower frequency of operation of antenna 600. In some embodiments, spacing 614 may be less than 0.1 wavelength at approximately the lower frequency of operation of antenna 600, and the diameter of first and second radiating elements 602 & 604 may be slightly less than approximately ¼ wavelength of the lower frequency of operation. In some embodiments, spacing 614 may range between approximately 20 and 40 mils for a lower frequency of operation selected from between 2.3 and 2.5 GHz. In some embodiments, the diameter of radiating elements 602 & 604 may range from between approximately one centimeter and three centimeters, although the scope of the invention is not limited in this respect.

In some embodiments, first radiating element 602 may receive a first signal component of an RF signal from a center conductor of coaxial connector 610, and second radiating element 604 may receive a second signal component of the RF signal from an outer conductor of coaxial connector 610. First radiating element 602 may be fed through a hole in second radiating element 604 at approximately the center of second radiating element 604.

In some embodiments, first and second radiating elements 602 & 604 may be fed substantially out-of-phase. In some embodiments, the signal components may comprise a multicarrier communication signal, although the scope of the invention is not limited in this respect.

Figure 7:
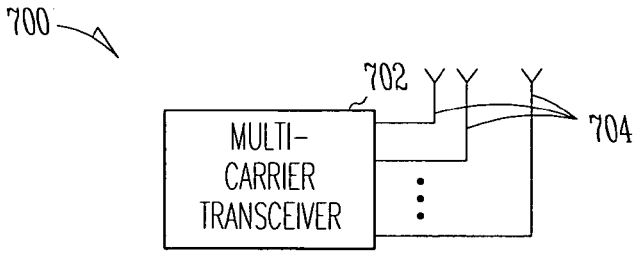
FIG. 7 illustrates a wireless communication system in accordance with some embodiments of the present invention.

FIG. 7 illustrates a wireless communication system in accordance with some embodiments of the present invention. Wireless communication system 700 may include transceiver 702 and one or more of antennas 704 for communicating wireless communication signals. In some wireless local area network embodiments, transceiver 702 may be a multicarrier transceiver and may communicate multicarrier communication signals using the two or more of antennas 704. In some embodiments, the multicarrier communication signals may comprise a plurality of substantially orthogonal symbol-modulated subcarriers. In some embodiments, transceiver 702 may employ antenna diversity to communicate more than one spatial data stream with the two or more of antennas 704, although the scope of the invention is not limited in this respect.

Antennas 704 may comprise directional or omnidirectional antennas, including, for example, dipole antennas, monopole antennas, loop antennas, microstrip antennas or other types of antennas suitable for reception and/or transmission of RF signals. In some embodiments, antennas 100 & 101 (FIGS. 1A through 1D), antennas 200 & 201 (FIGS. 2A through 2D), antennas 300 & 301 (FIGS. 3A through 3D), antenna 400 (FIGS. 4A & 4B), antenna 500 (FIG. 5) and/or antenna 600 (FIG. 6) may be suitable for use as one or more of antennas 702.

In some embodiments, communication system 700 may transmit and/or receive orthogonal frequency division multiplexed (e.g., OFDM) communication signals. In some embodiments, transceiver 702 may transmit and/or receive an OFDM packet on a multicarrier communication channel. The multicarrier communication signal may be within a predetermined frequency spectrum and may comprise a plurality of orthogonal subcarriers. In some embodiments, the orthogonal subcarriers of a multicarrier communication signal may be closely spaced OFDM subcarriers. To achieve orthogonality between closely spaced subcarriers, in some embodiments, the subcarriers of a particular multicarrier communication signal may have a null at substantially a center frequency of the other subcarriers of the multicarrier communication signal.

In some embodiments, communication system 700 be a communication station and may communicate with one or more other communication stations over a multicarrier communication channel. In some embodiments, the multicarrier communication channel may comprise either a standard-throughput channel or a high-throughput communication channel. In these embodiments, the standard-throughput channel may comprise a single multicarrier communication channel and the high-throughput channel may comprise a combination of one or more multicarrier communication channels and one or more spatial channels associated with each subchannel. Spatial channels may be non-orthogonal channels (i.e., not separated in frequency) associated with a particular multicarrier communication channel in which orthogonality may be achieved through beamforming and/or diversity.

In some embodiments, the frequency spectrums for a multicarrier communication channel may comprise either a 5 GHz frequency spectrum or a 2.4 GHz frequency spectrum. In some embodiments, the 5 GHz frequency spectrum may include frequencies ranging from approximately 4.9 to 5.9 GHz, and the 2.4 GHz spectrum may include frequencies ranging from approximately 2.3 to 2.5 GHz, although the scope of the invention is not limited in this respect, as other frequency spectrums are also equally suitable.

In some embodiments, communication system 700 may be a personal digital assistant (PDA), a laptop or portable computer with wireless communication capability, a web tablet, a wireless telephone, a wireless headset, a pager, an instant messaging device, a digital camera, an access point or other device that may receive and/or transmit information wirelessly. In some embodiments, transceiver 702 may transmit and/or receive RF communications in accordance with specific communication standards, such as the Institute of Electrical and Electronics Engineers (IEEE) standards including IEEE 802.11(a), 802.11(b), 802.11(g/h) and/or 802.11(n) standards for wireless local area networks (WLANs) and/or 802.16 standards for wireless metropolitan area networks (WMANs), although transceiver 702 may also be suitable to transmit and/or receive communications in accordance with other techniques including the Digital Video Broadcasting Terrestrial (DVB-T) broadcasting standard, and the High performance radio Local Area Network (HiperLAN) standard.

Referring to the antennas of FIGS. 1 through 7, the radiating elements may comprise a conductive material, such as copper, aluminum or gold, and the substrates may comprise almost any non-conductive or insulating material, including, for example, printed circuit board (PCB) material and insulating substrates.

Unless specifically stated otherwise, terms such as processing, computing, calculating, determining, displaying, or the like, may refer to an action and/or process of one or more processing or computing systems or similar devices that may manipulate and transform data represented as physical (e.g., electronic) quantities within a processing system's registers and memory into other data similarly represented as physical quantities within the processing system's registers or memories, or other such information storage, transmission or display devices.

Some embodiments of the invention may be implemented in one or a combination of hardware, firmware and software. Some embodiments of the invention may also be implemented as instructions stored on a machine-readable medium, which may be read and executed by at least one processor to perform the operations described herein. A machine-readable medium may include any mechanism for storing or transmitting information in a form readable by a machine (e.g., a computer). For example, a machine-readable medium may include read-only memory (ROM), random-access memory (RAM), magnetic disk storage media, optical storage media, flash-memory devices, electrical, optical, acoustical or other form of propagated signals (e.g., carrier waves, infrared signals, digital signals, etc.), and others.

The Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims.

In the foregoing detailed description, various features are occasionally grouped together in a single embodiment for the purpose of streamlining the disclosure. This method of disclosure is not to be interpreted as reflecting an intention that the claimed embodiments of the subject matter require more features than are expressly recited in each claim. Rather, as the following claims reflect, invention may lie in less than all features of a single disclosed embodiment. Thus the following claims are hereby incorporated into the detailed description, with each claim standing on its own as a separate preferred embodiment.

What is claimed is:

1. An antenna comprising:

a first radiating element disposed on a first side of an insulating substrate; and second radiating elements disposed on the first side of the insulating substrate; and a coplanar waveguide feed line disposed on the first side of the insulating substrate, wherein the coplanar waveguide feed line extends across the first side from a feed point between the second radiating elements to couple with the first radiating element, the coplanar waveguide feed line and the second radiating elements defining a coplanar waveguide structure of the coplanar waveguide feed line, wherein the first radiating element has a fanned-out shape, and wherein the second radiating elements together have a fanned out shape positioned in opposition to the first radiating element, and wherein the first and second radiating elements have a spacing therebetween having dimensions selected to impedance-match the antenna.

2. The antenna of claim 1 wherein the first and second radiating elements have a distance across of less than approximately ¼ wavelength at a lower frequency of operation for the antenna.

3. The antenna of claim 1 wherein the coplanar waveguide feed line is tapered from a feed point to the first radiating element, and wherein the feed line is narrower at the first radiating element and wider at the feed point.

4. The antenna of claim 3 wherein the feed line and the second radiating elements are fed substantially out-of-phase.

5. The antenna of claim 4 wherein one end of the feed line couples with the feed point to receive a first signal component of a radio-frequency (RF) signal from a center conductor of a coaxial connector, and wherein the second radiating elements further couples with the feed point to receive a second signal component of the RF signal from an outer conductor of the coaxial connector.

6. The antenna of claim 5 wherein the signal components comprise a multicarrier communication signal, the multicarrier communication signal comprising a plurality of substantially orthogonal subcarriers.

7. An antenna comprising:

a first radiating element with a curved base, a substantially flat top and substantially flat first and second opposite sides;

a feed line disposed on a first side of an insulating substrate and coupling with the curved base; and a second radiating element disposed on a second side of the insulating substrate, wherein the first radiating element has conductive material substantially covering the curved base, the substantially flat top and the substantially flat first and second opposite sides, wherein ends of the curved base couple with ends of the substantially flat top, wherein the curved base and the substantially flat top reside in a thickness dimension of the first radiating element, the thickness dimension being perpendicular to planes of the first and second sides of the insulating substrate, wherein the substantially flat first and second opposite sides of the first radiating element reside in planes parallel to the planes of the first and second sides of the insulating substrate, and wherein the thickness dimension of the first radiating element is substantially greater than a thickness of the insulating substrate.

8. The antenna of claim 7 wherein the feed line is coupled to the first radiating element at approximately a center of the curved base, wherein a curvature of the curved base, the thickness dimension, a width dimension and a height dimension of the first radiating element are selected to provide impedance-matching over a predetermined frequency bandwidth including a lower frequency of operation of the antenna.

9. The antenna of claim 7 wherein the feed line comprises a microstrip feed line.

10. The antenna of claim 8 wherein the feed line comprises a co-planar waveguide feed line.

11. The antenna of claim 8 wherein the first and second opposite sides reside in parallel planes and have either an approximate semicircular or semi-elliptical shape.

12. The antenna of claim 11 further comprising a support apparatus to support at least the first radiating element and to hold the first radiating element within a wireless communication device.

13. The antenna of claim 11 wherein the thickness dimension is at least 0.05 wavelength at approximately the lower frequency of operation, the width dimension is at least 0.3 wavelength at the lower frequency of operation, and the height dimension is at least 0.1 wavelength at approximately the lower frequency of operation.

14. The antenna of claim 11 wherein the feed line and the second radiating element are fed substantially out-of-phase.

15. The antenna of claim 14 wherein one end of the feed line couples with the feed point to receive a first signal component of a radio-frequency (RF) signal from a center conductor of a coaxial connector, and wherein the second radiating element further couples with the feed point to receive a second signal component of the RF signal from an outer conductor of the coaxial connector.

16. The antenna of claim 15 wherein the signal components comprise a multicarrier communication signal, the multicarrier communication signal comprising a plurality of substantially orthogonal subcarriers.

17. A wireless communication device comprising:

one or more antennas; and a multicarrier transceiver for communicating a multicarrier communication signal using the one or more antennas, wherein the one or more antennas comprise:

a first radiating element with a curved base, a substantially flat top and substantially flat first and second opposite sides;

a feed line disposed on a first side of an insulating substrate and coupling with the curved base; and a second radiating element disposed on a second side of the insulating substrate, wherein the first radiating element has conductive material substantially covering the curved base, the substantially flat top and the substantially flat first and second opposite sides, wherein ends of the curved base couple with ends of the substantially flat top, wherein the curved base and the substantially flat top reside in a thickness dimension of the first radiating element, the thickness dimension being perpendicular to planes of the first and second sides of the insulating substrate, wherein the substantially flat first and second opposite sides of the first radiating element reside in planes parallel to the planes of the first and second sides of the insulating substrate, and wherein the thickness dimension of the first radiating element is substantially greater than a thickness of the insulating substrate.

18. The device of claim 17 wherein the multicarrier communication signal comprises a plurality of substantially orthogonal symbol-modulated subcarriers, and wherein the multicarrier transceiver employs antenna diversity to communicate more than one spatial data stream with the two or more antennas.

* * * * *